US005861793A

United States Patent [19]

Hatton

[11] Patent Number: 5,861,793

[45] Date of Patent: Jan. 19, 1999

[54] RE-SETTABLE FUSE

[76] Inventor: Ken W. Hatton, 2129 W. Giddings, Chicago, Ill. 60625

[21] Appl. No.: 748,161

[22] Filed: Nov. 12, 1996

Related U.S. Application Data

[63] Continuation-in-part of Ser. No. 639,899, Apr. 29, 1996, Pat. No. 5,739,737.

[51] Int. Cl.[6] ..... H01H 85/143

[52] U.S. Cl. ..... 337/229; 337/227; 337/230

[58] Field of Search ..... 337/227, 159, 337/167, 180, 186, 201, 206, 229, 230, 237, 241, 257, 258, 259, 264, 283, 289, 284, 144; 361/834, 835

[56] References Cited

U.S. PATENT DOCUMENTS

| | | | |
|---|---|---|---|
| 5,384,559 | 1/1995 | Shamir | 337/197 |
| 5,388,022 | 2/1995 | Ahuja | 361/94 |
| 5,404,049 | 4/1995 | Canada et al. | 327/525 |
| 5,409,402 | 4/1995 | Ball et al. | 439/621 |
| 5,442,589 | 8/1995 | Kowalski | 365/225.7 |

*Primary Examiner*—Gregory Thompson
*Assistant Examiner*—Anatoly Vortman
*Attorney, Agent, or Firm*—Friscia & Nussbaum

[57] ABSTRACT

A re-settable fuse is provided with a movable cartridge containing a plurality of fuse elements. When a fuse is blown, a replacement fuse element may be installed into a circuit by moving, rotating or otherwise altering the position of the cartridge such that a new fuse element is inserted between electrical contacts mounted within the interior of the housing of the fuse. The bottom of the housing is configured to conform to a standardized shape of a fuse so that it may be installed into ordinary fuse box. Within the housing is a conductor which connects the fuse and the fuse element with the circuit wired into the fuse box. This conductor is exposed at the bottom of the fuse for connecting with the circuit.

10 Claims, 4 Drawing Sheets

RE-SETTABLE FUSE

RELATED APPLICATIONS

This is a continuation-in-part application of U.S. patent application Ser. No. 08/639,899, filed Apr. 29, 1996, now U.S. Pat. No. 5,739,737 by Hatton. The entire disclosure of this application is expressly incorporated herein by reference.

BACKGROUND OF THE INVENTION

1. Field of the Invention

This invention generally relates to a fuse that can be re-set, and more specifically to a fuse having a plurality of fuse elements which can be moved into position between fuse leads to re-set a fuse.

2. Related Art

Fuses are a necessary component of many electrical systems. Fuses maintain the safety of a circuit by physically opening themselves to interrupt the flow of an electrical current whenever an excessive electrical current has been detected. In prior inventions, the detection of an excessive electrical current was accomplished by means of a fuse filament which was designed to melt in response to the heat produced by an excessive electrical current. This excessive current may exist because too many electrical devices or appliances are operating as to create excessively low resistances within the circuit, thereby risking the hazard of a fire.

Because of their simplicity of design and operation, many varieties of fuses can be mass produced at low cost, thereby providing an inexpensive means to ensure circuit safety.

However, there are disadvantages when maintaining safety through the use of fuses. Paramount is that fuses do not replace themselves. Unlike a circuit breaker, which need only be reset after the unsafe electrical condition has been abated, once a fuse has burned out, it remains lodged within the circuit requiring a person to perform a manual and tedious chore to remove the opened fuse and reinsert another entirely new fuse of like size, specification and capacity. Often this task of replacement requires the use of tools. If tools are not used, and sometimes even if they are, there is a risk to the person replacing the fuse of electrical shock as his or her skin might come into contact with a powered circuit.

Furthermore, fuse replacement is often made more aggravating by the fact that the open fuse must first be located among many similar fuses which are still in working order. Typically, all of the fuses for a system are grouped together within a single cabinet known as a "fuse box." Because fuse boxes are not pleasing to the eye, they are often installed within locations that are not conveniently or directly accessible to the consumer of electrical power. Once located, the consumer finds the fuse box to be packed with many identical or near identical fuses that are positioned in an arrangement that obscures the identity of the particular fuse which is in non-working order.

Accordingly, to locate the opened fuse, a person must use a chart to identify the component or circuit that has discontinued operating, and then match the chart against the arrangement of fuses within the fuse box to locate the non-working fuse. As one might expect, such a search for a blown fuse is much more difficult to perform if conducted in the absence of adequate lighting.

Also, since fuses blow at times that are inconvenient to the user, there exists a need for a storage device by which a replacement fuse element can be housed in a position that is electrically insulated from the circuit it is later to protect, but close enough to its future operating site that the consumer of electrical power does not have to conduct a rambling and disorganized search, often at a relatively remote location from the fuse box, for a compatible replacement fuse.

Ideally, it would be preferable if the replacement fuse element could be inserted into the circuit without the need for actual physical contact with the installer. In other words, to quickly move the fuse element from its storage position directly into the circuit to be protected. Such an system of replacement would eliminate nearly all of the tediousness and inconvenience that arise during the time of replacement.

Furthermore, such a system could abate the need for using an entirely new fuse to replace a blown fuse. Rather, only a component of the fuse, the fuse element, would need to be replaced.

Examples of previous efforts at re-settable circuit protection devices include:

Ahuja, U.S. Pat. No. 5,388,022 discloses an auto-rest circuit breaker having at least one solid state switch ( e.g. a triac, SCR or complimentary FET) that is biased to be normally closed and mounted in series with a shunt resistor or shunt resistor network. The shunt resistor creates a drop in voltage that is continuously measured, and may be converted from an analog to a digital value, to protect the circuit within the line from over-voltage or over-current conditions. Not relying upon thermal or electromagnetic relays, the circuit breaker provides instantaneous protection at an electronic speed.

Kowalski, U.S. Pat. No. 5,442,589 discloses a fuse circuit having a single physical fuse that is to be electrically blown and a non-volatile memory cell which confirms the condition of the fuse by measuring the current though a transistorized current divider network. Detection of a blown fuse is accomplished in the following manner: in the intact state, the low resistance of the fuse causes the current to bypass a parallel mounted transistor circuit and electrical ground. Should voltage overload conditions cause the fuse element to deteriorate, the resulting high resistance of the open fuse causes the current to reach electrical ground via the lower resistance path of the transistor circuit. The transistor circuit is preferably an Electrically Erasable Programmable Read-Only Memory (EEPROM) type floating gate transistor that is made of technology similar to that of the fuse.

Swensen, U.S. Pat. No. 5,420,561 discloses a circuit breaker or re-settable fuse device having a normally relaxed shape memory wire which receives heat from a resistor. Under prolonged overload current conditions, the resistor generated heat causes the shape memory wire to contract and shift a moveable terminal out of contact with a fixed stationary terminal, thereby interrupting electrical current in the circuit to be protected. Only when the overload conditions are removed does the current though the resistor drop to a point where the resultant heat is insufficient to maintain the contracted condition of the shape memory wire. The breaker or fuse thereby automatically resets itself.

Ball, et al., U.S. Pat. No. 5,409,402 discloses a device that houses a conventional fuse and permits installation without the use of tools. The interior of the rigid housing contains a pair of terminals and a fuse element that is positioned between these terminals by electrical contacts. Attached to the exterior of the housing are two plug portions, each of which extend in opposite axial directions, that are shaped for insertion and retention within the fuse socket. By removing or inserting the plug portion, the fuse is removed or installed within the circuit to be protected.

Canada, et al., U.S. Pat. No. 5,404,049 discloses a fuse blow circuit. The circuit includes an address buffer incorporated within a VLSI (Very Large Scale Integrated) semiconductor chip, which makes use of its existing input/output pads that are dedicated to other circuit functions, to determine the condition of fuses. Also included are a fuse latch chip, a fuse blow chip and a fuse sense chip. These three chips are required for each fuse used. A fuse control circuit is included and may be shared for a bank of fuses. The fuse sense circuit continuously tests a fuse by measuring a voltage drop across a resistor that receives a trickle current from a transistor. If an excessively high voltage opens a fuse element, the transistor becomes saturated. The fuse latch circuit determines if a fuse is to be blown or electrically overridden.

Shamir, U.S. Pat. No. 5,384,559 discloses both an electrical plug and a spare fuse holder embodied within a single fire retardant plastic housing. The housing is configured to have a channel wherein a spliced electrical cord may be inserted with no danger of inadvertently making contact without being in series with the fuse element. The housing also contains two chambers: The first chamber has a cavity where the fuse element can be separately contained while being in series with the inserted conductor. A second chamber stores the replacement fuse so that it is not part of the circuit to be protected. The housing and its fuse chambers are shaped, positioned and constructed so that the replacement fuse need only be withdrawn from its storage chamber and inserted into the first chamber which formerly held the blown fuse. The chambers are formed to be easily opened to permit easy fuse replacement.

None of these previous efforts disclose all of the benefits of the present invention, nor do these previous patents teach or suggest all of the elements of the present invention.

OBJECTS AND SUMMARY OF THE INVENTION

It is a primary object of the present invention to provide a re-settable fuse.

It is another object of the present invention to provide a fuse having one or more fuse elements which can be moved into position between fuse leads to reset a fuse.

It is another object of the present invention to provide a means to readily indicate the number of fuses which are available for replacement purposes.

It is another object of the present invention to provide an apparatus having multiple fuse elements, which apparatus is less expensive than a corresponding amount of fuses.

It is even another object of the present invention to provide an apparatus which obviates the need for tools to perform, or aid in performing, the task of re-setting or replacing a fuse.

It is even another object of the present invention to provide an apparatus that cuts down on the cost of replacement fuses.

It is even another object of the present invention to provide an apparatus having a plurality of fuse elements on a carrier.

It is even another object of the present invention to provide an apparatus having a round carrier with fuse elements positioned diametrically about the carrier.

It is even another object of the present invention to provide an apparatus that can be rotated to bring fuse elements into contact with electrical leads to reset the fuse.

It is even another object of the present invention to provide an apparatus having a carrier in the shape of a block with fuse elements positioned to extend across the block.

It is yet another object of the present invention to provide an apparatus which includes a block carrier that can be pushed to move one or more fuse elements into contact with electrical leads.

It is yet another object of the present invention to provide a means by which the replacement fuses may be fabricated within a cartridge that is contained within a housing which may be easily inserted into a fuse box.

It is yet another object of the present invention to provide an apparatus that is easy to manufacture.

It is yet another object of the present invention to provide an apparatus that is simple to reset.

It is yet another object of the invention to provide a re-settable fuse which functions with the convenience of a circuit breaker.

It is also an object of the present invention to provide a means by which a blown fuse is easily identified.

It is also an object of the present invention to provide an apparatus that is sized to fit into a conventional fuse box.

These and other objects are achieved by the apparatus of the present invention which comprises a re-settable fuse. When a fuse is blown, rather than replacing same, one merely re-sets the fuse by physically rotating, depressing, pushing or otherwise moving a replacement fuse element to contact the fuse leads of the fuse, thereby inserting the new fuse element directly into the line of the circuit to be protected. As such, the fuse of the present invention has multiple lives before it is ultimately entirely blown.

In one embodiment of the present invention the carrier is round and constructed either as a cylinder or disk. The carrier is rotated as a means of replacing fuses.

In another embodiment the carrier is a block or geometric shape comprising two or more pairs of parallel planes. The carrier is moved in a linear direction as a means of replacing fuses.

BRIEF DESCRIPTION OF THE DRAWINGS

Other important objects and features of the invention will be apparent from the following Detailed Description of the Invention taken in connection with that accompanying drawings in which.

DETAILED DESCRIPTION OF THE INVENTION

Figure 1:
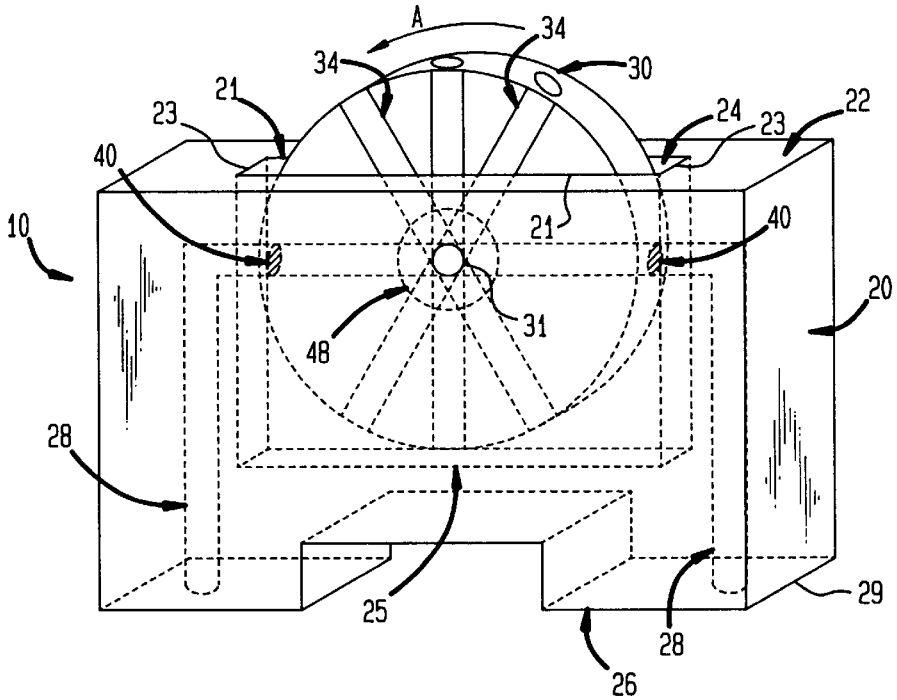
FIG. 1 is a perspective view of a re-settable fuse of the present invention having a plurality of fuse elements on a thin disk that can be rotated to reset a fuse.

Referring to FIG. 1, the re-settable fuse of the present invention is generally indicated at 10. The re-settable fuse 10 comprises a housing generally indicated at 20 having an upper surface 22 with a receptacle 24 formed thereon. The receptacle 24 is sized and configured to accept a rotatable disk cartridge, generally indicated at 30.

In a preferred embodiment, the receptacle has two sets of opposing interior walls 21 and 23. The first set of interior receptacle walls 21 is comprised of two surfaces which are each substantially wide enough the accommodate the thickness of the rotatable disk cartridge 30. At directly opposing points on the surfaces of the interior receptacle walls 21 may be a pair of apertures or indentations or other means for receiving an axial member 31 of the rotatable disk cartridge, for retaining the cartridge within the receptacle and for permitting rotation thereof as will hereinafter be described.

The second set of interior receptacle walls 23 is comprised of two surfaces which are each substantially wide enough to accommodate the diameter of the rotatable disk cartridge 30. Positioned at the surfaces of interior receptacle walls 23 are one or more pairs of opposing electrical contacts, generally indicated at 40.

The bottom surface of the receptacle 25 could be shaped and configured in any desired manner as long as it does not obstruct the angular rotation of the rotatable disk cartridge 30.

The housing 20 of the fuse 10 includes legs 26 as is conventionally known. Leads 28, having lower contact surfaces at the lower ends of the legs 26, extend up through the legs to the opposing electrical contacts 40 on the interior receptacle walls 23.

As is known in the art, fuses are normally positioned within electrical systems between the electrical source and the electrical components of a system. Made from a suitable metal, metallic compound or other electrically conducting material, each fuse element 34 monitors the flow of electrical current therethrough. Should the flow of electricity exceed a predetermined level, the fuse element 34 burns out or "blows" to create an open circuit to thereby discontinue the flow of electricity to the circuit to be protected. With the re-settable fuse of the present invention, after a fuse element blows, another fuse element can be advanced into position to contact opposing leads 40 to complete the circuit and re-set the fuse. Each of these fuse elements 34 may be applied on the surface of the disk cartridge 30 or inserted within the disk cartridge 30.

As is also shown in FIG. 1, at the center of the rotatable disk cartridge 30 contains a conducting material 48 that is designed to maintain electrical integrity and not melt, burn or otherwise open in response to an excessive electrical current. The fuse elements 34 are positioned to extend diametrically across the cartridge interconnecting with the conductive material 48 at the center of the cartridge.

In many electrical systems, fuses are typically held in place by contacts which, while made of a suitable conducting material and part of the electrical circuit to be protected, have a mechanical stiffness that is sufficient to hold the fuse in the proper position. In the present invention, the electrical contacts 40 are mounted within the interior of the receptacle 24 to make physical contact with the fuse element 34 associated with the rotatable disk cartridge 30 that is positioned therebetween.

Also, the electrical contacts 40 could be located sufficiently deep into the interior of the receptacle 24 so that they may not be readily touched by a person making incidental tactile contact with the re-settable fuse 10. Such positioning would ensure that the horizontal diameter of the rotatable cylindrical cartridge lies in a lower geometric plane than the upper surface of the housing 22.

Furthermore, to make the re-settable fuse 10 usable in an electrical system, the base 29 of each leg 26 of the housing is shaped and configured to plug into the standardized receptacles of a conventional fuse box or blown fuse indicator.

Thus, as seen from FIG. 1, each time an excessive current in a circuit causes the horizontally positioned fuse element 34 to burn, melt or otherwise open, replacement is easily and conveniently performed by rotating the disk cartridge 30 in the direction of arrow A to a new angular position so that another fuse element 34 is horizontally located between the opposing electrical contacts 40. The mechanical stiffness of said electrical contacts 40 should be sufficient to maintain the rotatable disk cartridge 30 in a stationary position until such time as a person causes the rotatable disk cartridge 30 to undergo a subsequent angular displacement to install a new fuse element 34 into a horizontal position.

Over a lifetime of use, once all of the fuses 34 stored within the rotatable disk cartridge 30 have blown, the re-settable fuse 10 may be unplugged from its fuse box and completely replaced or, if more convenient, economical or environmentally preferable, the rotatable disk cartridge 30 may be detached from the housing 20 replaced within the same existing fuse. The former approach may be preferable should the electrical conductors 28 within the housing's legs 26 become damaged due to fatigue or overload conditions.

Figure 2:
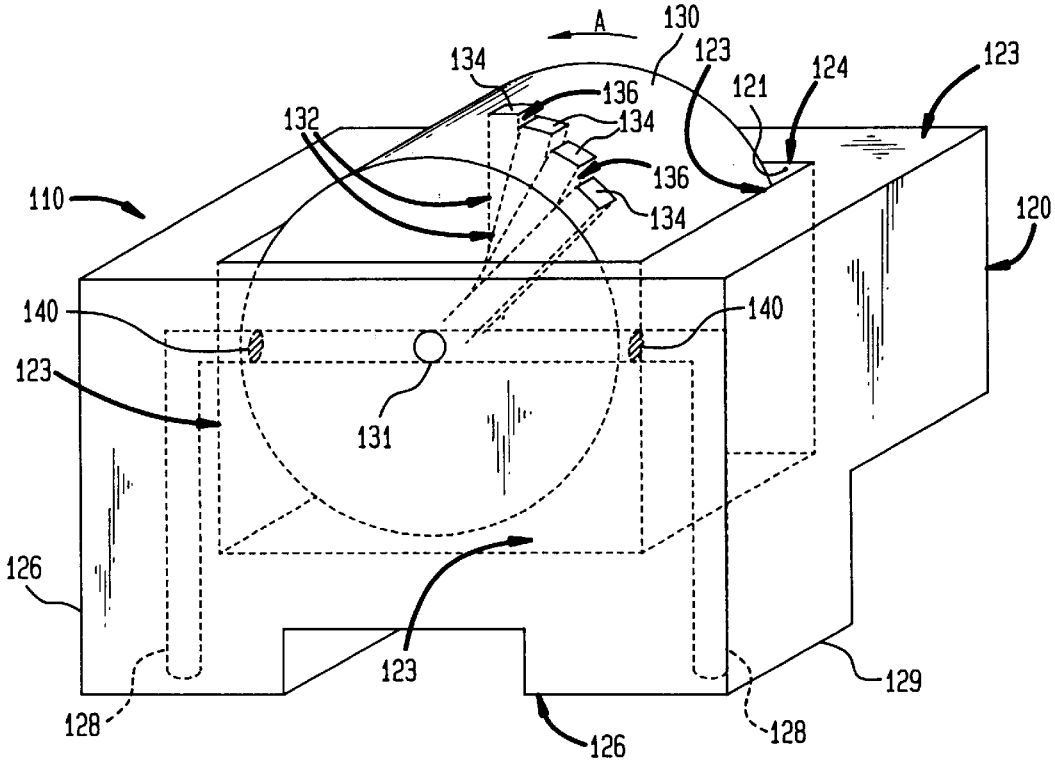
FIG. 2 is a perspective view of another embodiment of the re-settable fuse of the present invention having a plurality of fuse elements on a cylinder that can be rotated to reset a fuse.

FIG. 1 has been used to illustrate the present invention as a mechanically operated electrical safety device having a rotatable disk cartridge 30 which stores both the active and replacement fuse elements. FIG. 2 illustrates a modified embodiment of the present invention.

Figure 3:
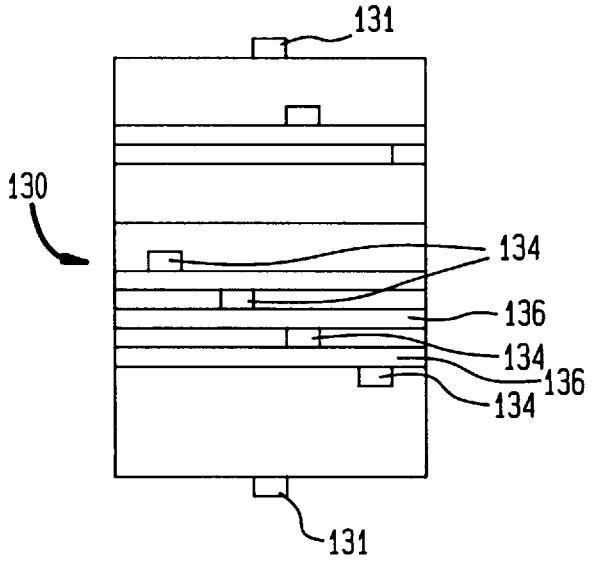
FIG. 3 is a top view of a rotatable cylindrical fuse cartridge shown in FIG. 1.
Figure 4:
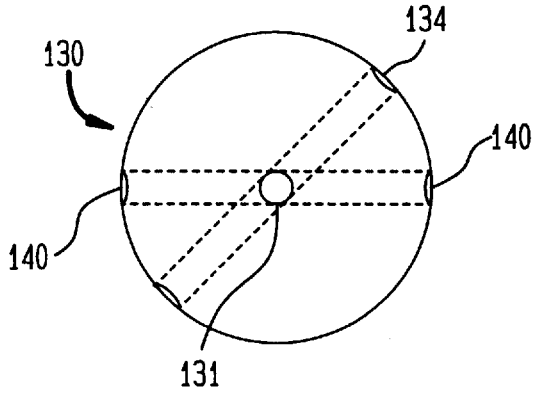
FIG. 4 is a side view of a rotatable cylindrical fuse cartridge shown in FIG. 1.

In the embodiment of the invention generally indicated as 12 in FIG. 2, and further shown in FIGS. 3 and 4, a rotatable cylindrical cartridge 130 contains a plurality of cavities 132, each of which houses a fuse element 134. Just as with the earlier embodiment, the rotatable cylindrical cartridge rotates about an axial member 131. This is shown in FIG. 4.

Each cavity 132 and the fuse element 134 enclosed therein, is positioned to extend diametrically across the rotatable cylindrical cartridge 130 and is separated from the adjacent fuse and cavity by electrically insulating material 136. Alternatively, each fuse element 134 could be positioned between layers of insulating material forming the rotatable cylindrical cartridge 130.

The electrical contacts 140 located within the interior of the modified receptacle 124 must be as wide as the distance between the fuse elements of the rotatable cylindrical cartridge 130. This is shown in FIG. 3. However, to minimize or negate many of the effects of excessive heat and any electrical arcing that may occur prior to or during the opening of a fuse 134, the contacts 140 may be divided into a plurality of smaller contacts, each electrically attached to the lead 128 residing within the leg 126, and positioned accordingly so that the electrical integrity of the replacement fuse is not compromised as a result of a previous overload condition. In this way, the corrosion and fatigue which arise through normal use may be checked.

Similarly, the housing 120, its upper surface 122, its receptacle 124, its legs 126 and its interior walls 121 and 123 may be shaped and configured to be larger than a conventional fuse housing, but the base of each leg 129 should be shaped and configured to plug into the standardized receptacles of a conventional fuse box or blown fuse indicator.

Figure 5:
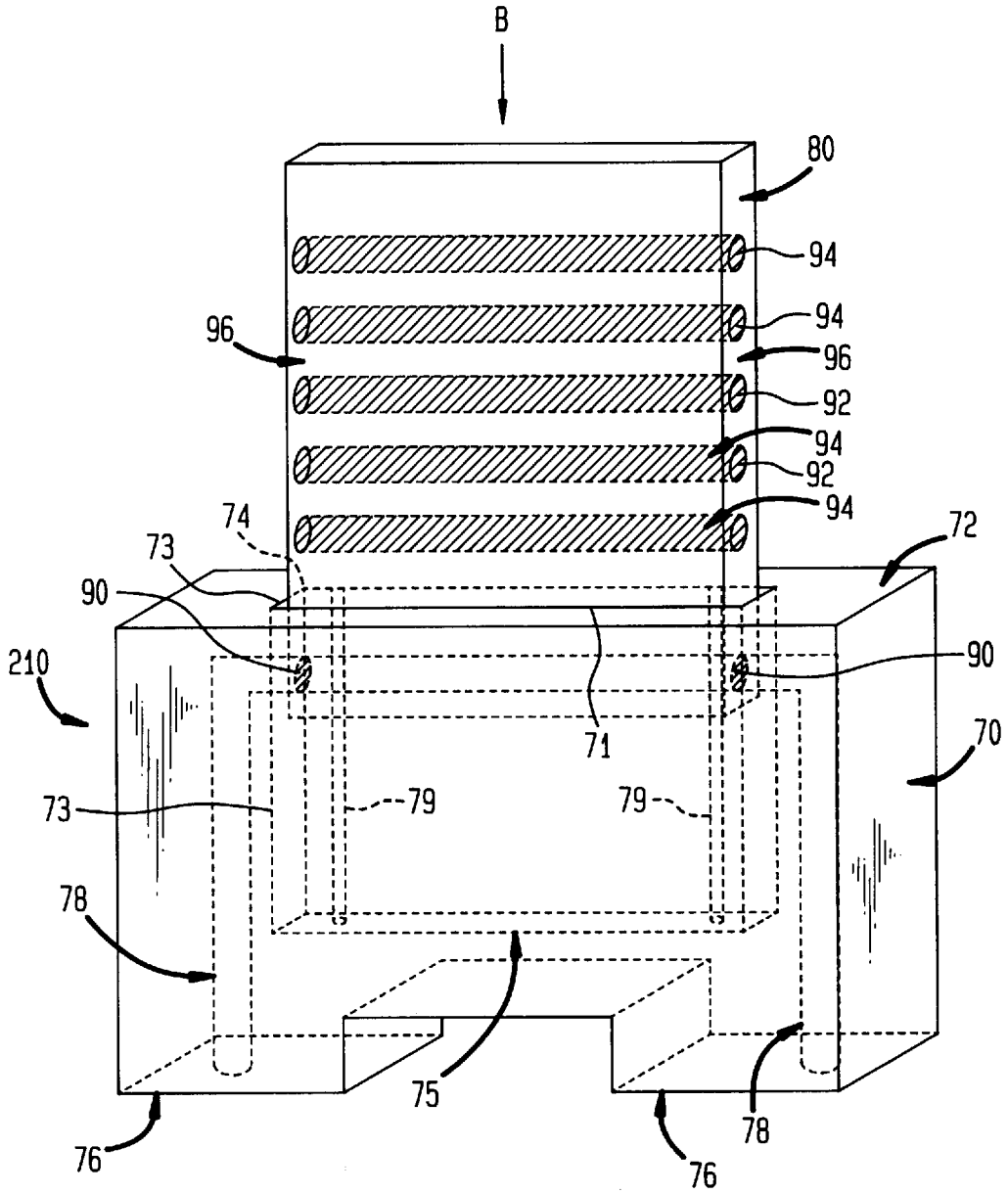
FIG. 5 is a perspective view of another embodiment of a re-settable fuse of the present invention having a plurality of fuse elements within a cartridge which can be linearly moved to reset a fuse.

FIG. 5 illustrates another embodiment of the present invention having a linearly movable cartridge bearing fuse elements to effect the replacement of a fuse element.

Referring to FIG. 5, the re-settable fuse of the present invention is generally indicated at 210. The re-settable fuse 210 comprises a housing generally indicated at 70, having an upper surface 72 with a receptacle 74 formed thereon. The receptacle 74 is sized and configured to accept a linearly movable cartridge, generally indicated at 80. The cartridge 80 can be moved in the direction shown by arrow B to re-set the fuse. It should also be pointed out that such a cartridge can be provided and a fuse housing configured that the cartridge can be moved in any desired direction to re-set the fuse. Accordingly, a receptacle could be positioned to extend within a housing from a side wall of the housing and the cartridge could be moved horizontally through the housing.

As shown in FIG. 5, the receptacle 74 has two sets of opposing interior walls 71 and 73. The first set of interior receptacle walls 71 includes two surfaces which are each substantially wide enough the accommodate the width of the linearly movable cartridge 80. Tracks or pathways 79 may be fabricated into any or each of the interior receptacle walls 71, 73. These tracks or pathways 79 may extend the depth of the receptacle for guiding the linearly movable cartridge 80 into its various correct positions for proper fuse replacement.

The second set of interior receptacle walls 73 includes two surfaces which are each substantially wide enough to accommodate the thickness of the linearly movable cartridge 80. Upon the surfaces of interior receptacle walls 73 are one or more pairs of opposing stationary electrical contacts, generally indicated at 90.

The bottom surface of the receptacle 75 is located sufficiently deep within the housing so as not to block or otherwise obstruct the displacement of the linearly movable cartridge 80. In some embodiments of the present invention it may not even be necessary to include a bottom surface to the receptacle 75 and merely allow the linearly movable cartridge 80 to travel completely or near completely through the housing 70 as fuse elements 94 are replaced. In still other embodiments of the present invention, if the receptacle 75 cannot be made deep enough, the linearly movable cartridge 80 may be shaped and configured to be completely removed from the receptacle 74 and flipped over prior to being re-inserted into the receptacle 74.

The housing 70 of the fuse 14 would also include legs 76 as is conventionally known. Leads 78 having lower contact surfaces at the lower ends of the legs 76 extend up through the legs to the to the opposing electrical contacts 90 on the interior receptacle walls 73.

In the embodiment of the invention shown in FIG. 5, the linearly movable cartridge 80 contains a plurality of cavities 92, each of which houses a fuse element 94. Each cavity 92 and the fuse 94 enclosed therein, is positioned completely across the width of the linearly movable cartridge 80 and is separated from the adjacent fuse and cavity by either a physically open space or electrically insulating material 96. Alternatively, each fuse element 94 could be positioned between layers of insulating material forming the linearly movable cartridge 80.

Figure 6:
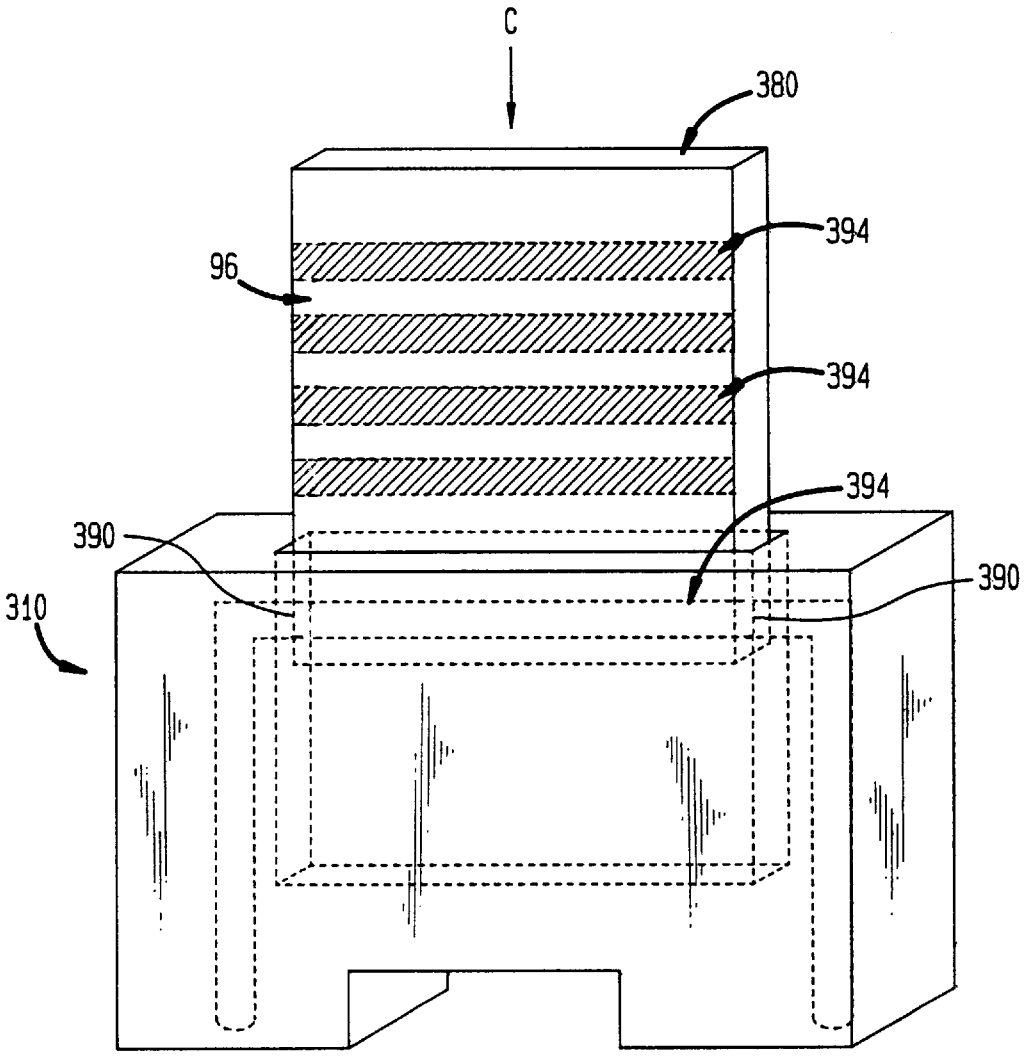
FIG. 6 is a perspective view of another embodiment of a re-settable fuse of the present invention having a plurality of fuse elements on the surface a cartridge that can be linearly moved to reset a fuse.

As shown in FIG. 6, the fuse elements 394 may be positioned on the surface of the linearly movable cartridge 380. Of course, such fuse elements could also be positioned within channels or indentations on the cartridge 380, or arranged in any way known in the art.

In the embodiments of the present invention shown in FIGS. 5 and 6, each fuse element 94, 394 is made from a suitable metal, metallic compound or electrically conducting material and monitors the flow of electrical current therethrough. Should the flow of electricity exceed a predetermined level, the fuse element 94, 394 burns out to create an open circuit thereby discontinuing the flow of electricity to the circuit to be protected.

Furthermore, each fuse element 94, 394 is held in place by electrical contacts 90, 390 which, while made of a suitable conducting material and part of the electrical circuit to be protected, have a mechanical stiffness that is sufficient to hold the fuse element in the proper position. In the present invention, a pair of electrical contacts 90, 390 are to make physical contact with the particular fuse element 94, 394 of the linearly movable cartridge 80, 380 that is positioned therebetween.

Additionally, said contacts 90, 390 should be of a size and shape wide enough to maintain good electrical contact with any of the stored fuse elements 94 that are inserted into the circuit to be protected.

Furthermore, to make the re-settable fuse 210, 310 usable in an electrical system, the base 79 of each leg 76 of the housing is shaped and configured to plug into a standardized receptacles of a conventional fuse box or blown fuse indicator.

Thus, as seen from FIGS. 5 and 6, each time an excessive current in a circuit causes a fuse element 94, 394 to burn, melt or otherwise open, replacement is easily and conveniently performed by pushing or depressing the linearly movable cartridge 80, 380 in the direction of arrow B, C to a new position so that another fuse element 94, 394 is horizontally located between the opposing electrical contacts 90, 390.

Any of the embodiments of the present invention discussed herein may be equipped with indicators which signal the presence of a blown fuse. Blown fuse indicators 99 could use either fuse element 34, 94 or 394 as the electrical connection to an indicating component such as a light emitting diode in accordance with the teachings of U.S. patent application Ser. No. 08/639,899, filed Apr. 29, 1996 by Hatton, the entire disclosure of which is expressly incorporated herein by reference.

Having thus described the invention in detail, it is to be understood that the foregoing description is not intended to limit the spirit and scope thereof. What is desired to be protected by the Letters Pat. is set forth in the appended claims.

What is claimed is:

1. A resettable fuse comprising:

a housing having a lower end for insertion into a fuse box;

receptacle means extending into the housing, the receptacle means including at least one interior wall;

electrical contact means on the at least one interior wall, the electrical contact means electrically connected to a fuse box by contact with an electrical lead in a fuse box;

cartridge means positioned at least partially within the receptacle means, the cartridge means carrying a plurality of fuse elements for positioning between the electrical contacts to reset a fuse; and axial means for rotatably affixing the cartridge means within the receptacle means;

wherein the cartridge means comprises a disk having opposite sides, an axis and an outer curved surface, and having an electrical conductor on one side at the axis, and the plurality of fuse elements extend radially from the conductor to the outer surface of the cartridge.

2. The resettable fuse according to claim 1, further comprising blown fuse indicator means interconnected with the electrical lead in a fuse box.

3. The resettable fuse of claim 1 wherein each of the fuse elements comprising the plurality of fuse elements are separate from each other by insulating means.

4. The resettable fuse according to claim 1, wherein the axial means comprises an axial member extending from the opposite sides of the cartridge means for engagement with receptacles formed within the at least one interior wall of the housing for retaining the cartridge within the housing.

5. A resettable fuse comprising:

a housing having a lower end for insertion into a fuse box;

receptacle means extending into the housing, the receptacle means including at least one interior wall;

electrical contact means on the at least one interior wall, the electrical contact means electrically connected to a fuse box by contact with an electrical lead in a fuse box;

cartridge means positioned at least partially within the receptacle means, the cartridge means carrying a plurality of fuse elements for positioning between the electrical contacts to reset a fuse; and axial means for rotatably affixing the cartridge means within the receptacle means;

wherein the cartridge means comprises a rotatable cylinder, having flat surfaces at each end, and the plurality of fuse elements extend diametrically across the cartridge, and each of the plurality of fuse elements is insulated from the other of the plurality of fuse elements.

6. The resettable fuse according to claim 5, further comprising blown fuse indicator means interconnected with the electrical lead in a fuse box.

7. The resettable fuse according to claim 5, wherein the axial means comprises an axial member extending from the opposite sides of the cartridge means for engagement with receptacles formed within the at least one interior wall of the housing for retaining the cartridge within the housing.

8. A resettable fuse comprising:

a housing having a lower end for insertion into a fuse box;

receptacle means extending into the housing, the receptacle means including opposing interior walls;

electrical contacts means on the opposing interior walls, the electrical contact means electrically connected to a fuse box by contact with an electrical lead in a fuse box;

cartridge means for carrying a plurality of fuse elements; and axial means for rotatably affixing the cartridge means within the receptacle means;

wherein, when a fuse element blows, the cartridge means can be manipulated to position a new fuse element between the electrical contacts to reset the fuse; and wherein the cartridge means comprises a disk having opposite sides, an axis and an outer curved surface, and having an electrical conductor on one side at the axis, and the plurality of fuse elements extend radially from the conductor to the outer surface of the cartridge.

9. The resettable fuse according to claim 8, further comprising blown fuse indicator means interconnected with the electrical lead in a fuse box.

10. The resettable fuse according to claim 8, wherein the axial means comprises an axial member extending from the opposite sides of the cartridge means for engagement with receptacles formed within the at least one interior wall of the housing for retaining the cartridge within the housing.

* * * * *